United States Patent [19]

Lesko et al.

[11] Patent Number: 5,061,921

[45] Date of Patent: Oct. 29, 1991

[54] REMOTE-CONTROLLED MESSAGE SIGN

[75] Inventors: Darryl S. Lesko, Glendale Heights; Dennis J. Clem, North Aurora, both of Ill.

[73] Assignee: White Way Sign Company, Chicago, Ill.

[21] Appl. No.: 328,736

[22] Filed: Mar. 23, 1989

Related U.S. Application Data

[63] Continuation of Ser. No. 94,009, Sep. 19, 1987, abandoned.

[51] Int. Cl.[5] ..... G09G 3/20

[52] U.S. Cl. ..... 340/815.24; 340/815.08; 340/825.44; 340/311.1

[58] Field of Search ..... 340/825.44–825.49, 340/815.24, 311.1, 905, 323 R, 825.69, 825.72, 764, 815.08; 40/471, 518; 455/31–38; 318/16; 379/57

[56] References Cited

U.S. PATENT DOCUMENTS

| | | | |
|---|---|---|---|
| 3,094,682 | 6/1963 | Brosh et al. | 340/22 |
| 3,255,445 | 6/1966 | Randel | 340/334 |
| 3,532,822 | 10/1970 | O'Hanlon | 179/2 |
| 3,546,696 | 12/1970 | Waters et al. | 340/323 R |
| 3,614,727 | 10/1971 | Fritts | 40/471 |
| 3,720,913 | 3/1973 | Bradford | 340/31 R |
| 3,732,558 | 5/1973 | Justice | 340/330 |
| 3,783,193 | 1/1974 | Lee | 179/2 A |
| 3,822,493 | 7/1974 | Maley | 40/471 |
| 4,135,144 | 1/1979 | Elmasian | 340/32 |
| 4,178,476 | 12/1979 | Frost | 340/825.49 |
| 4,208,630 | 6/1980 | Martinez | 340/825.72 |
| 4,491,690 | 1/1985 | Daley | 179/2 A |
| 4,599,615 | 7/1986 | Umetsu | 340/825.44 |
| 4,618,860 | 10/1986 | Mori | 340/825.44 |
| 4,642,425 | 2/1987 | Guinn, Jr. et al. | 379/57 |
| 4,682,148 | 7/1987 | Ichikawa et al. | 340/825.44 |
| 4,707,938 | 11/1987 | Carssow | 40/471 |
| 4,769,641 | 9/1988 | Yoshizawa et al. | 340/825.44 |
| 4,803,487 | 2/1989 | Willard et al. | 340/825.44 |

FOREIGN PATENT DOCUMENTS

| | | | |
|---|---|---|---|
| 0193527 | 8/1986 | Japan | 340/825.44 |

*Primary Examiner*—Alvin E. Oberley
*Assistant Examiner*—Richard Hjerpe

[57] ABSTRACT

A remote-controlled message sign in controlled by a pager. The pager receives radio signals from a paging service and provides output signals in response to the radio signals. The output signals of the pager are used to control one or more drive motors. Each drive motor moves a multiple-position message device to a position in response to the output signal of the pager.

7 Claims, 6 Drawing Sheets

FIG. 1
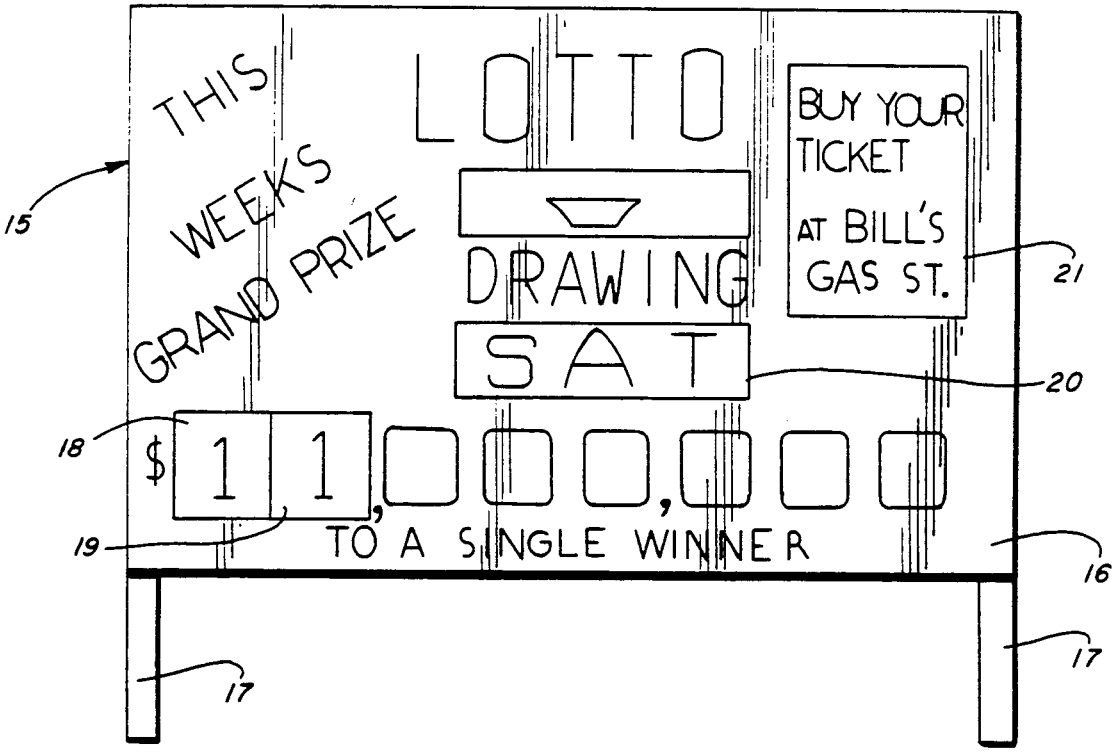
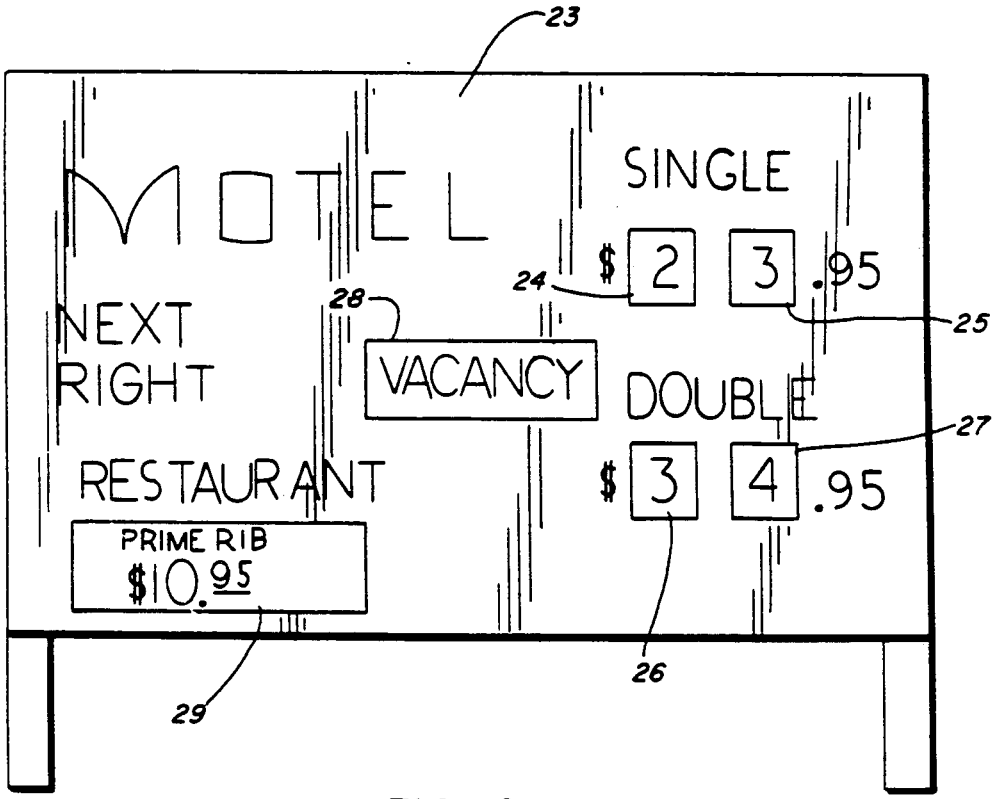
FIG. 2

FIG. 3
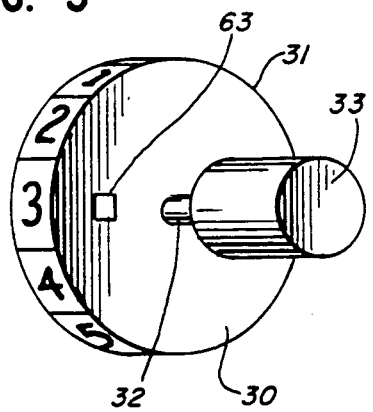
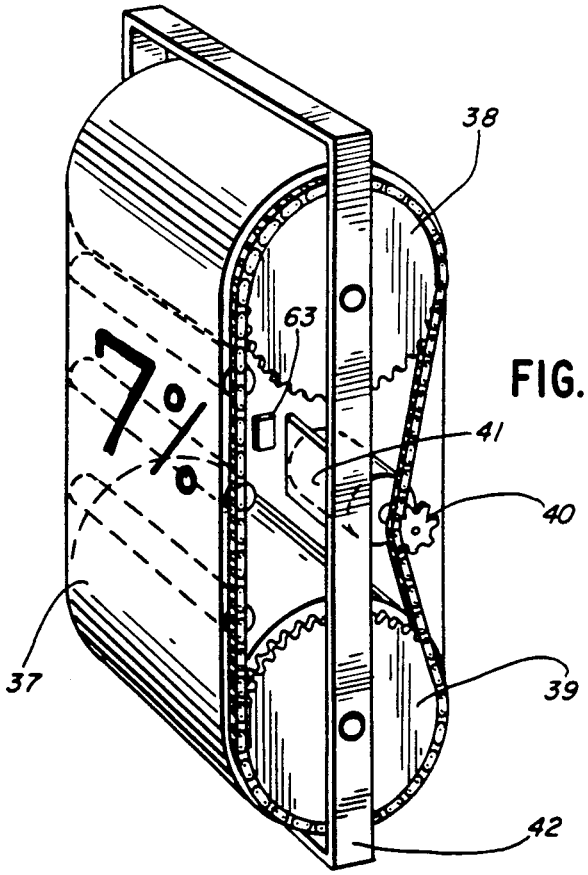
FIG. 5
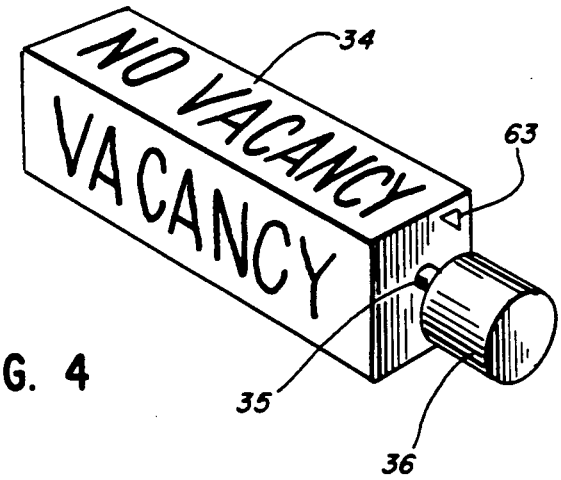
FIG. 4
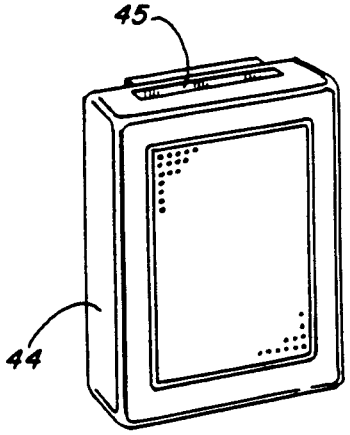
FIG. 6

REMOTE-CONTROLLED MESSAGE SIGN

This application is a continuation of application Ser. No. 094,009, filed Sept. 4, 1987, now abandoned.

BACKGROUND

This invention relates to message signs, and, more particularly, to a message sign which is operated by remote control by a pager.

Many message signs include movable display devices which are movable between multiple positions. A different message is displayed in each position. For example, a motel sign might include a display device which is movable to display a "Vacancy" sign or a "No Vacancy" sign. Lottery billboards might include means for displaying the amount of the current jackpot and the date of the next drawing.

Signs which include multiple position display devices must include means for changing the position of the devices when it is desired to change the information which is displayed. Some signs are operated manually, and others may be electrically controlled. However, manual or electric operation is impractical when the sign is located a substantial distance away or when a number of signs are involved. Lottery signs are often mounted on highway billboards, and the information on a substantial number of signs must be changed frequently. At the present time the information on most lottery signs is changed manually, which results in substantial labor expense.

Proposals have been made to operate signs by remote control by telephone lines or by radio signals. However, each of these methods has serious disadvantages. A telephone-controlled system requires a telephone line connection to each sign. The installation and subscription fees can be substantial. Radio-controlled signs must be located close to the transmitter unless a powerful transmitter is used, which is expensive and might require licensing approval and regulation.

SUMMARY OF THE INVENTION

The invention utilizes a standard pager or beeper to control a multiple position sign. A pager is ordinarily used to inform the owner of the pager of a telephone number that he should call. A person who wishes to contact the owner of the pager dials the telephone number of the pager and is thereby connected to a paging service. The caller then dials his seven or ten digit telephone number which is transmitted by radio signals by the paging service to the pager. The electrical circuit of the pager receives the input signals and provides corresponding output signals, for example on a liquid crystal display, which inform the owner of the number which is to be called.

The portion of the circuit of the pager which provides the output signals is connected to a control circuit in the sign which provides a drive signal in response to the output signal of the pager. The drive signal is used to actuate a drive mechanism which moves the display device to the desired position.

DESCRIPTION OF THE DRAWING

The invention will be explained in conjunction with an illustrative embodiment shown in the accompanying drawing, in which—

FIG. 1 is an illustration of one type of sign which can be used with the invention;

FIG. 2 is an illustration of another type of sign which can be used with the invention;

FIG. 3 is a perspective view of one type of movable display device which can be used with the invention;

FIG. 4 is a perspective view of another type of movable display device;

FIG. 5 is a perspective view of another movable display device;

FIG. 6 is a perspective view of a pager;

DESCRIPTION OF SPECIFIC EMBODIMENT

Figure 7:
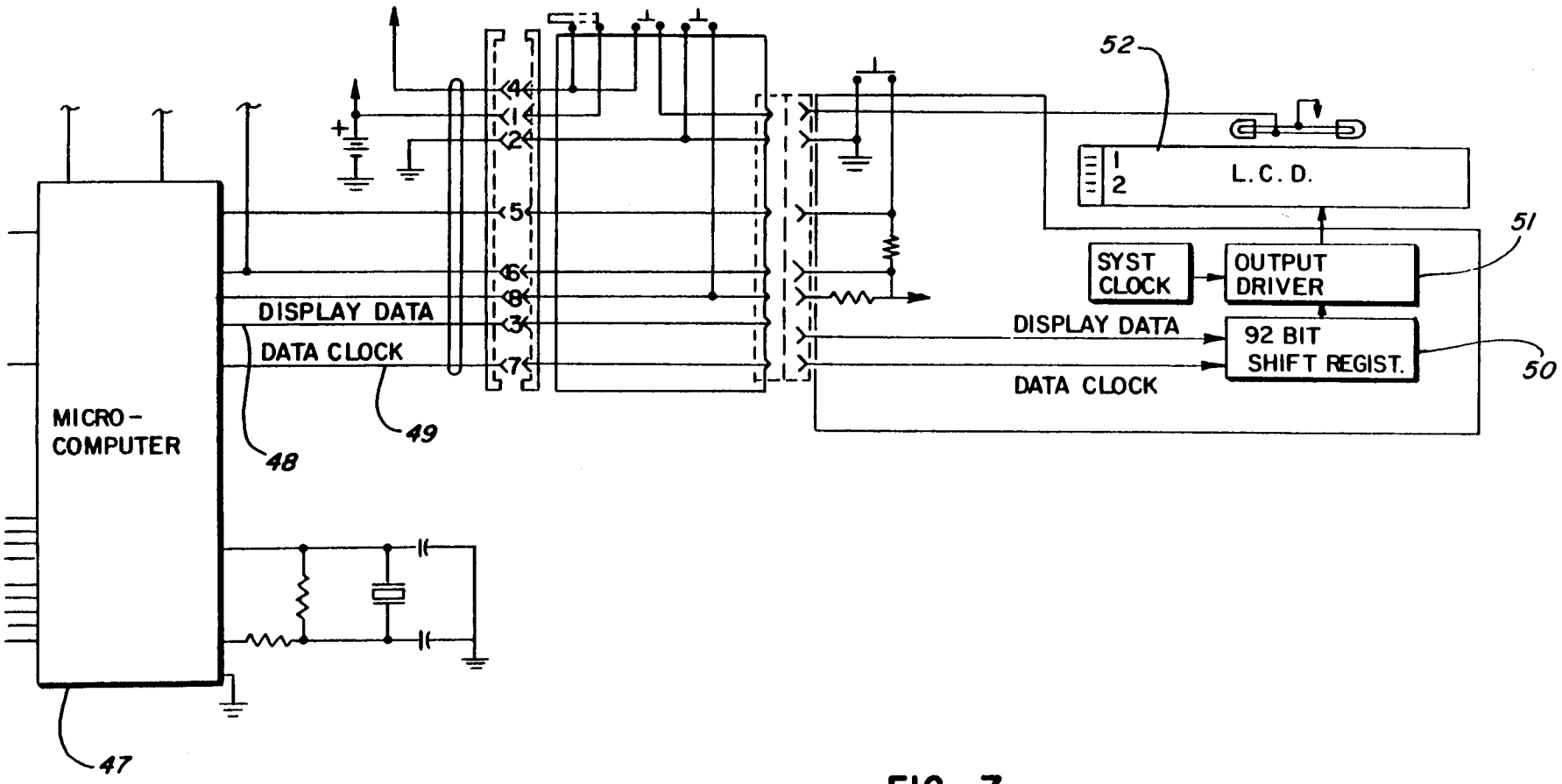
FIG. 7 is a portion of the circuit diagram of the pager.

FIG. 1 illustrates a message sign 15 which is a billboard-type sign which includes a frame 16 and a pair of support posts 17. The sign includes printed information relating to a lottery and four display devices 18 through 21. The display devices are positioned in windows or openings in the frame 16. Each display device is rotatably mounted on the frame so that the display device can be moved to position different information in the window. For example, the display devices 18 and 19 bear numbers 0 through 9. The display device 20 bears the day of the next lottery drawing, for example, Saturday. The display device 21 includes various promotional messages of advertisers.

FIG. 2 illustrates a motel sign 23 which includes six movable display devices 24 through 29. The display devices 24–27 carry the numbers 0 through 9. The display device 28 bears the words "Vacancy" and "No Vacancy" and perhaps other desired messages. The display device 29 advertises various meal or drink specials which are served at the motel.

FIGS. 3 through 5 illustrate examples of movable display devices. FIG. 3 illustrates a wheel or drum 30 which includes an outer cylindrical surface 31 and an axle 32 which is rotatably mounted on the sign. Numbers 0 through 9 are printed on the outer cylindrical surface. A drive motor 33 rotates the wheel until the desired number is positioned in the window of the sign.

FIG. 4 illustrates a four-sided drum 34. Each side bears an appropriate message, for example, "Vacancy" or "No Vacancy." The drum is rotatably supported by an axle 35 and is driven by a motor 36.

FIG. 5 illustrates an endless belt 37 which is rotated by sprockets 38 and 39. A drive sprocket 40 is rotated by a motor 41 and engages the lower sprocket 39. Various interest rates, for example 7%, are printed on the belt 37. The sprockets are rotatably mounted within a frame 42 which is mounted on the sign.

FIG. 6 is a perspective view of a conventional pager 44. The particular pager illustrated is a BPR 2000 Series pager available from Motorola, Inc. The pager is sized to fit in a pocket or be carried on a belt and is about 3.1 inches high, 2.3 inches wide, and less than 1 inch thick. The pager is powered by a 1.5 volt AA size battery. The pager includes a liquid crystal display 45 which displays up to 12 numerals The operation of a pager is well known. Each pager is assigned a seven digit access number (or a ten digit number including area code) by a commercial paging service. When the access number is dialed on a telephone, the telephone is connected to the paging service.

After the connection is made, the caller hears a beep signal, and he then dials the seven or ten digit telephone number which he wants the owner of the pager to call. The paging service then transmits a radio signal which corresponds to the seven or ten digit number of the caller. The signal is received by the receiving circuit of the pager which has been assigned the access number which was first dialed. The pager then issues an audible signal and displays the caller's seven or ten digit telephone number on the LCD of the pager.

The electronic circuit of conventional pagers is also well known to those skilled in the pager art. FIG. 7 illustrates a portion of the circuit of the Motorola pager. The radio signals from the paging service are received by the receiving circuit of the pager and sent to a microprocessor 47. The pager is capable of receiving and displaying signals corresponding to twelve digits. The microprocessor 47 issues output signals on display data line 48 and data clock line 49. The output signals correspond to the radio frequency input signals which in turn correspond to the seven or ten digit telephone number of the caller. The output signals are fed to a 92 bit shift register 50. The output of the shift register is fed to an output driver 51 which in turn causes the caller's telephone number to be displayed on the twelve digit LCD 52.

Figure 8:
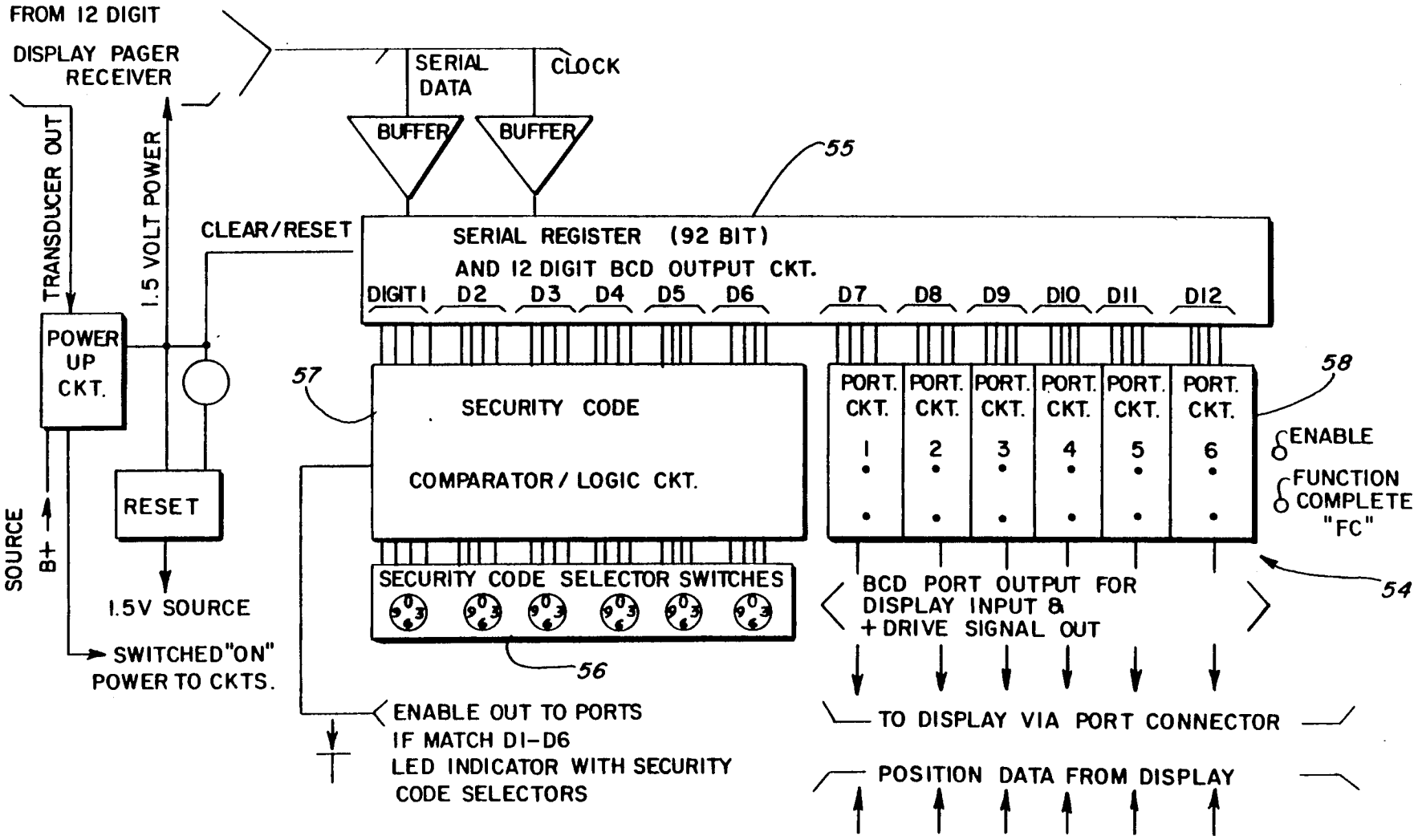
FIG. 8 is a portion of the circuit diagram of the control circuit.

The pager 44 is modified for use in the invention by connecting the display data line 48 and the data clock line 49 to the electric circuit 54 illustrated in FIG. 8. Serial data and clocking from lines 48 and 49 are fed to a 92 bit serial register 55. The register converts the data to twelve individual binary code decimal (BCD) outputs representing the twelve digits which were inputted to the pager by the paging service.

Several digits, for example six, of the twelve digit input can be used as a security code. The security code is unique to a particular sign and is selected by six selector switches 56. Each selector switch is used to select a number from 0 to 9, and the number is fed into a security code comparator logic circuit 57. The six digit security code makes accidental or deliberate access to the control circuit of the sign extremely unlikely.

The first six digits D-1 through D-6 are fed by the serial register 55 to the comparator 57. If these six digits exactly match the six digit security code selected by the switches 56, the comparator circuits enable the control circuit 58.

BCD digit outputs D-7 through D-12 of the serial register 55 are fed to ports 1 through 6 of the control circuit 58 The circuitry for all six ports is identical, and the port circuits could be made in modular fashion to facilitate manufacturing.

Figure 9:
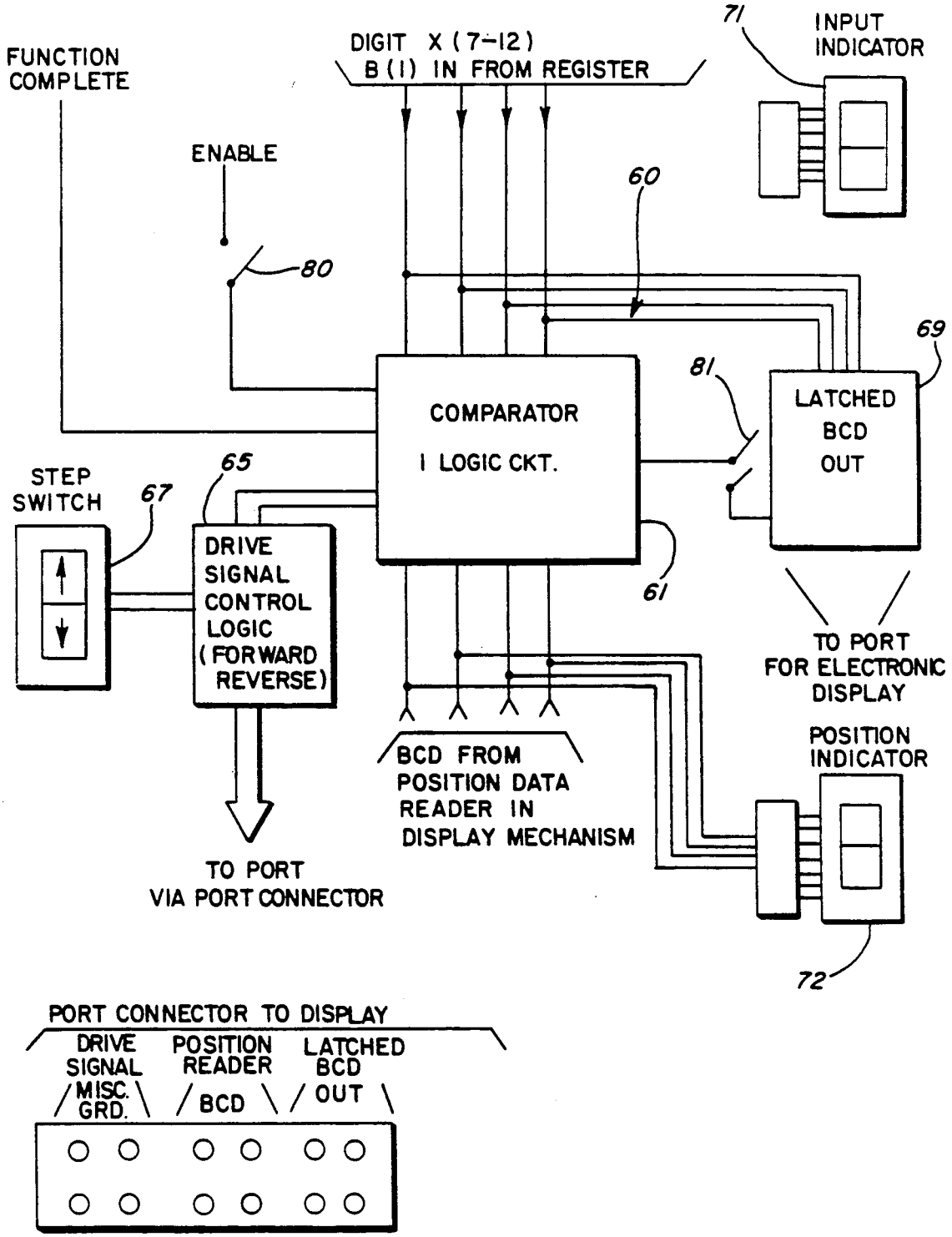
FIG. 9 is another portion of the circuit diagram of the control circuit.

FIG. 9 illustrates the circuit 60 of one of the ports. A comparator logic circuit 61 compares BCD input information from the serial register 55 with current BCD information from a position data reader for one of the movable display devices of the sign. For example, referring to FIG. 3, a position data reader 63 on the drum 30 determines the position of the drum relative to the window in the sign and which number is displayed. The position data reader provides BCD information on the position to the comparator 61.

If the BCD input to the comparator 61 from the serial register 55 is equal to the BCD information from the position data reader 63, then no drive signal is needed and the comparator logic circuit makes the function complete lead. The function complete lead clears and resets the register so that the register is prepared for the next input.

If the BCD input is not equal to the BCD information from the position data reader, then the drive signal control logic circuit 65 determines the direction (forward or reverse) in which the display device needs to move in order to arrive at the inputted position and provides a drive signal to the motor 33 (FIG. 3) which moves the display device. When the display device arrives at the position which corresponds to the input from the register 55, the BCD input to the comparator 61 from the register is equal to the BCD information from the position data reader, and the comparator logic circuit inhibits output to the drive signal control logic circuit 65. The drive signal control logic circuit in turn inhibits drive signal output, and the motor stops. The comparator logic circuit then marks the function complete lead.

In addition to providing appropriate drive signals, the drive signal control logic circuit may allow for a display stepping function for display testing and maintenance purposes A stepping rocker switch 67 indicates the direction of the desired movement of the display mechanism and causes the drive signal control logic circuit to output the appropriate drive signal, causing the display mechanism to step.

Latched BCD output 69 is provided for direct electronic display input.

LED numeral indicators 71 and 72 for input and display position data facilitate testing and maintenance. The input indicator 71 indicates the inputted information (a numeral from 0 to 9) corresponding to the port digit, and the position indicator 72 indicates the position of the display mechanism.

Figure 10:
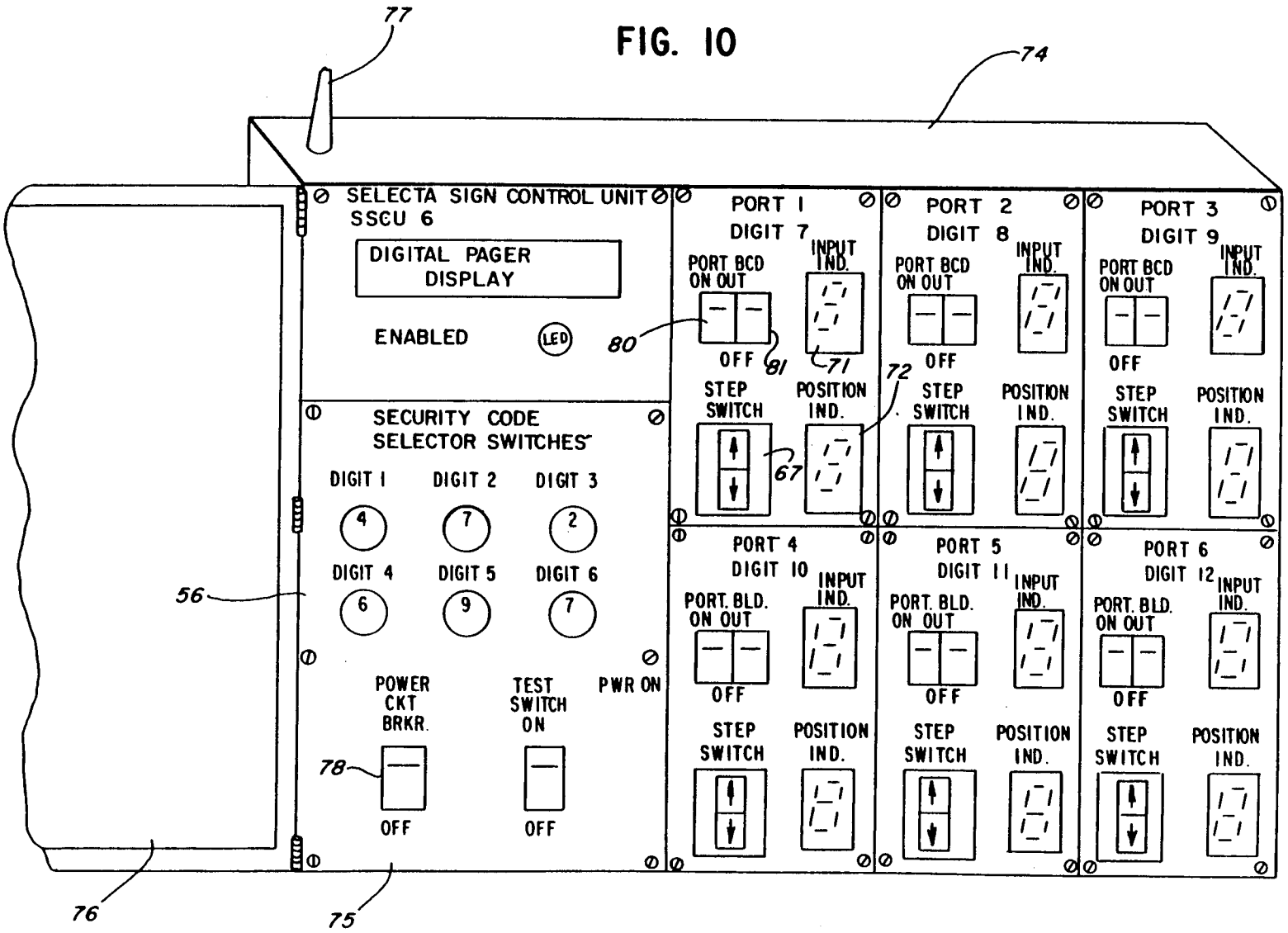
FIG. 10 is a perspective view of the control panel of a remote-controlled message sign.

FIG. 10 illustrates the control box 74 for controlling the display devices of the sign. The control box 74 is mounted on the sign and includes a front panel 75 and a cover 76. An antenna 77 extends through the top of the control box for receiving the radio signals from the paging service.

Power is supplied to the various circuits behind the control panel through a circuit breaker switch 78. The power can be supplied by 115 volt ac, batteries or by solar panels.

The security selector switches 56 are mounted on the left side of the control panel. The right side of the control panel includes 6 sections for the six ports of the control circuit 58. Each section includes input and position indicators 71 and 72, on-off switches 80 and 81 for the port and BCD output, and a stepping switch 67.

The six ports of the control circuit 58 can be used to control six display devices such as the display devices illustrated in FIGS. 1–5. If security code protection is not needed, then all 12 BCD outputs from the pager can be used to provide input to 12 ports for controlling 12 display devices.

The sign illustrated in FIG. 1 includes 4 display devices 18–21 which are controlled by ports 1–4 of the control circuit 58. The display devices 18 and 19 include numerals 0–9 and are controlled by ports 1 and 2. The display device 20 includes two or more days of the week, for example Monday through Saturday, and is controlled by port 3. The days Monday through Saturday correspond to numerical inputs 2–7, respectively. The display device 21 could contain up to 10 messages and is controlled by port 4. The position of the display device 21 which is illustrated in FIG. 1 might correspond to input numeral 1.

As an example, let us assume that the access number of the pager which controls the sign of FIG. 1 is 234-5555 and that the security code for the sign is 543678. In order to activate the display devices so that they move to the position illustrated in FIG. 1, the sign operator first dials the access number—234-5555. When the telephone connection to the paging service is made, a beep signal is heard. The operator then dials 543678117100. The first six digits are the security code which causes security comparator 57 to enable the control circuit 58. The next two digits cause the control circuit to move each of the display devices 18 and 19 to position one. The digit 7 causes the display device 20 to move to position seven which displays "Saturday." The digit 1 causes the display device 21 to move to position one. The last two digits are inoperative since the sign has only four display devices.

If the sign operator wanted to change the amount of the lottery prize to $25,000,000 and keep the remaining information unchanged, he would dial: 234-5555 and then: 543678257100.

Commercial paging services charge a monthly fee for transmitting messages to a pager. The fee might include a base charge and a use charge which depends on how often the pager is called. However, the pager fee is substantially less than the cost of alternate methods of operating a sign by remote control.

Any number of signs can be operated simultaneously by equipping each sign with a pager having the same access number and by using the same security code and the same code plug. A code plug is a standard plug-in component of the pager. This feature greatly increases the economics and user flexibility of remote-controlled signs.

The various electronic components described herein are conventional components whose design and function are well known. The following specific information is given for purpose of illustration:

| Part | Source |
|---|---|
| Serial Register 55 | Cascaded arrangement of sprague Part No. UCN-5818A |
| Comparators 57 and 61 | Texas Instruments Part No. TLC374 or Motorola Part No. MC3302 |
| Position Data Reader 63 | A device which outputs BCD display position information; it may be accomplished by means of an optical construction using photo transistors, e.g., Philips Part No. ECG3031, or it may be constructed by means of an arrangement of electrical switch contacts |
| Drive Circuit 65 | A device for providing a drive signal or voltage to drive the sign display mechanism, for example, Motorola Part No. 74HC193 in combination with Philips Part No. ECG270 |
| Latched BCD Output 69 | Provides signal output for electronic numeral displays or "Flip-O-Matic" numeral display devices, for example, Motorola Latch Part No. 74HC77 |
| Numeral Indicators 71 and 72 | Philips Part Number ECG3054 |

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A method of operating a remote-controlled billboard sign comprising:

mounting a commercial telephone pager receiver on a sign having a plurality of information-providing indicia which are movable between a plurality of positions, the commercial pager receiver being interconnected to the sign for receiving an input signal from a telephone via a commercial telephone paging service and to provide an output signal in response to the telephone input signal, providing an interconnect circuit means to said pager receiver with a control circuit means on the sign for receiving said output signal from the commercial pager and for providing a drive control signal in response thereto, said interconnect circuit means includes a serial shift register for conveying serial data signals from the pager receiver and providing a plurality of binary code decimal output signals in response to the telephone input signal, providing a first comparator means with the interconnect circuit means for enabling the control circuit means when a portion of the output signals from the interconnect circuit means corresponds to a predetermined security code signal, said control circuit means includes a position data reader means for providing a signal corresponding to the position of the indicia and a second comparator circuit means for comparing a portion of the output signals of the interconnect circuit means with the signals from the position data reader means, providing drive means on the sign for moving the information-providing indicia to one of said positions in response to said drive control signal, making a telephone line connection between a telephone and a commercial telephone paging service by inputting the telephone number of said commercial pager receiver, and consecutively inputting a twelve digit control number with said telephone so that the commercial telephone paging service will transmit said control number to said commercial pager receiver as said telephone input signal.

2. A remote controlled billboard sign apparatus for remotely controlling a billboard sign display solely in response to numbers inputted via a telephone and telephone lines to a commercial paging service which transmits the telephone input to a commercial display pager receiver interconnected to the sign apparatus, said sign apparatus comprising:

a frame, a display device bearing a plurality of information providing indicia and being movably mounted on the frame for movement between a plurality of positions in which the indicia are displayed, a position data reader mounted on the frame for providing binary coded decimal output signals corresponding to the position of the display indicia, security code selector switches on the frame for outputting binary code decimal signals corresponding to a selected security code, a commercial display pager receiver mounted on the frame for receiving input signals solely from the commercial paging service, a pager interconnect circuit means with a serial shift register on the frame for interconnecting to the commercial display pager receiver, for conveying serial data signals from the pager receiver, and for providing a plurality of binary code decimal output signals in response to the telephone input, a first comparator means on the frame for receiving as an input signal a portion of the binary code decimal signals outputted from the pager interconnect circuit means, comparing said input signal with binary code decimal signals outputted from the security code selector switches, and providing an output enable control signal, a control circuit means on the frame for controlling the display device, said control circuit means receiving one of said binary code decimal output signals from the pager interconnect circuit means and providing a drive signal in response thereto, said control circuit means including:

a second comparator means for receiving an input binary code decimal signal from the pager interconnect circuit means, comparing said input with binary code decimal signals outputted from the position data reader means and providing an output drive control signal in response to the input signal, logic circuit means interacting with said pager interconnect circuit means for providing control for the display device, said logic circuit means receiving the enable control signal from the first comparator means and outputting function complete control signals, and drive means for receiving the drive control signal from the second comparator means and for providing a drive signal to the display device, said drive means moving the display device to one of said positions in response to the drive control signal.

3. The apparatus of claim 2 in which said control circuit means receives one preassigned output signal from the plurality of output signals provided by the interconnect circuit means and provides a drive signal in response thereto.

4. The apparatus of claim 2 wherein the first comparator means compares a portion of the output signals from the pager interconnect circuit means with a predetermined security code signal and enables the control circuit means when the output signal corresponds with the predetermined security code signal.

5. The apparatus of claim 2 in which said display device is a roller having an outer surface and an axle rotatably mounted on the frame, said information-providing indicia being positioned on the outer surface.

6. A remote controlled billboard sign apparatus for remotely controlling billboard sign displays solely in response to numbers inputted via a telephone and telephone lines to a commercial paging service which transmits the telephone input to a commercial display pager receiver interconnected to the sign apparatus, said sign apparatus comprising:

a frame, a plurality of display devices, each bearing a plurality of information providing indicia and being movably mounted on the frame for movement between a plurality of positions in which the indicia are displayed, a position data reader mounted on the frame for providing binary coded decimal output signals corresponding to the position of the display indicia, security code selector switches disposed on the frame for outputting binary code decimal signals corresponding to a selected security code, a commercial display pager receiver mounted on the frame for receiving input signals solely from the commercial paging service, a pager interconnect circuit means with a serial shift register disposed on the frame for interconnecting to the commercial display pager receiver, for conveying serial data signals from the pager receiver, and for providing a plurality of binary code decimal output signals in response to the telephone input, a first comparator means disposed on the frame for receiving as an input signal a portion of the binary code decimal signals outputted from the pager interconnect circuit means, comparing the input signal with binary code decimal signals outputted from the security code selector switches, and for providing an output enable control signal, control circuit means disposed on the frame for controlling each of the plurality of display devices, said control circuit means including a plurality of control circuits, each control circuit being preassigned to receive one of the plurality of binary code decimal output signals from the said pager interconnect circuit means and to provide a drive signal in response thereto, said control circuit means also including:

a second comparator means for receiving an input binary code decimal signal from the pager interconnect circuit means, comparing said input with binary code decimal signals outputted from the position data reader means and providing an output drive control signal in response to the input signal, logic circuit means interacting with the pager interconnect circuit means for providing control for the plurality of display devices, said logic circuit means receiving the enable control signal from the first comparator means and outputting function complete control signals, and drive means for receiving said drive control signal from the second comparator means and for providing a drive signal to the plurality of display devices, said drive means moving the display device to one of said positions in response to the drive control signal.

7. The apparatus of claim 6 wherein the first comparator means compares a portion of the output signals from the pager interconnect circuit means with a predetermined security code signal and enables the control circuit means when the output signal corresponds with the predetermined security code signal.

* * * * *